United States Patent [19]

MacLaughlin

[11] Patent Number: 4,583,656

[45] Date of Patent: Apr. 22, 1986

[54] CONTAINER WITH IMPROVED SEALING LIP

[75] Inventor: Donald N. MacLaughlin, Midland, Mich.

[73] Assignee: Vercon, Inc., Dallas, Tex.

[21] Appl. No.: 745,106

[22] Filed: Jun. 17, 1985

[51] Int. Cl.[4] ..... B65D 41/00

[52] U.S. Cl. ..... 220/359; 220/310; 215/232; 215/326

[58] Field of Search ..... 220/362, 359, 309, 310; 215/324, 326, 327, 1 C, 31, 232

[56] References Cited

U.S. PATENT DOCUMENTS

| | | | |
|---|---|---|---|
| 3,039,646 | 6/1962 | Merz | 220/309 |
| 3,478,913 | 11/1969 | Kemp | 215/326 |
| 3,499,567 | 3/1970 | Spotts | 215/324 |
| 4,496,066 | 1/1985 | Bullock, III | 215/31 |

*Primary Examiner*—George T. Hall

*Attorney, Agent, or Firm*—Michael J. Caddell; M. Norwood Cheairs

[57] ABSTRACT

A container and preferably a thermoplastic container, is disclosed which offers an improved structure around the container top opening to allow better sealing of a crimped-on closure member.

4 Claims, 7 Drawing Figures

FIG. 5
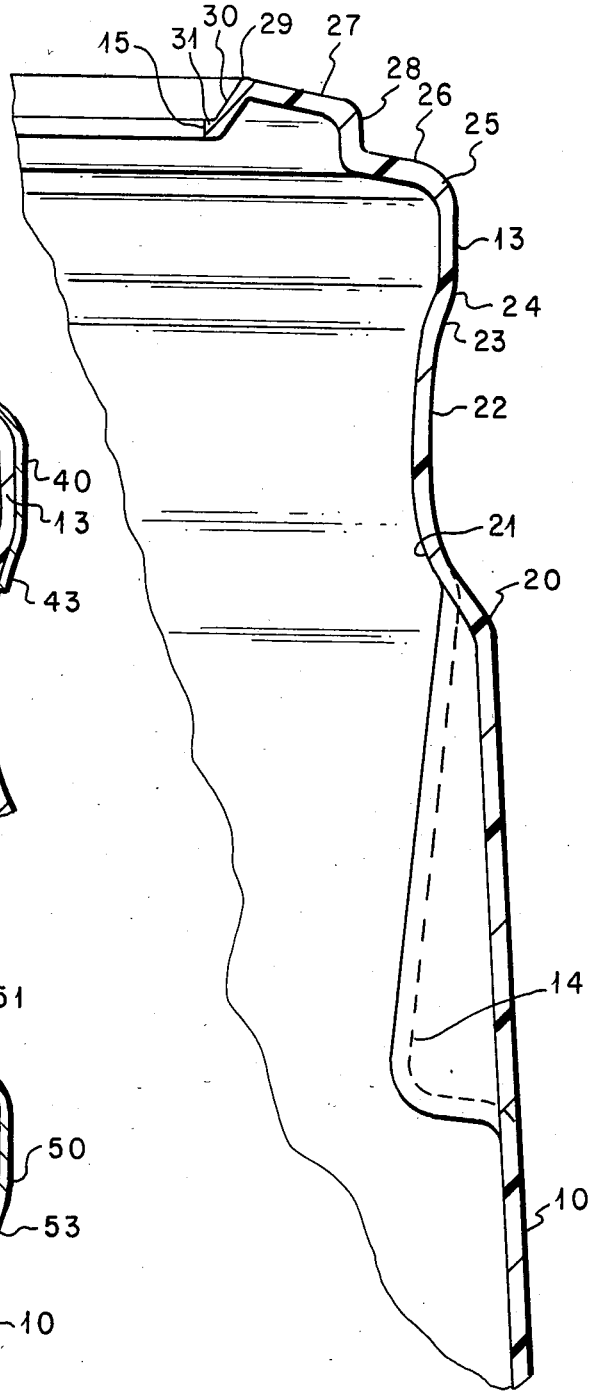
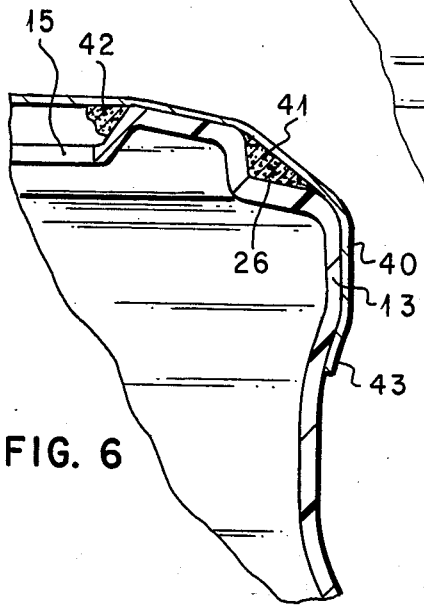
FIG. 6
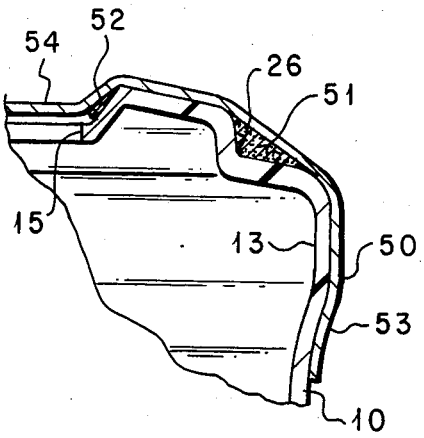
FIG. 7

CONTAINER WITH IMPROVED SEALING LIP

BACKGROUND OF THE INVENTION

This invention pertains to containers and more particularly involves thermoplastic containers with improved specific structure in the lip sealing area of the container top opening. The container is of the type generally disclosed in U.S. Des. Pat. No. D252,796 to Vincent E. Fortuna and Matt Lerner, issued Sept. 4, 1979, entitled "CONTAINER FOR FOOD PRODUCTS OR THE LIKE".

The container disclosed in the aforementioned Fortuna et al patent utilizes a large top opening defined by a flat-topped outer annular surface which has a rolled rim at its outer periphery (see FIG. 2). The rolled rim terminates in a short, inset vertical wall portion which extends downwardly a short distance and then diverges conically downward and outward to merge with the slightly-tapered vertical sidewall of the container. The flat-topped annular top portion, having a hemispherical or rolled outer rim, provides the sealing surface for the container closure member (not shown).

In the containers of the type disclosed in the Fortuna et al patent, the most common type of closure member utilized to seal off the container opening is the crimpable type usually comprising a thin metal foil, paper or plastic cap which is attached to the container by an adhesive plus the crimping action of the cap over the rolled outer rim of the container.

The problem with this type of container/cap structure has been the difficulty of obtaining a crimped cap that is properly sealed and yet can be removed by the consumer without need for undue ripping, tearing and/or cutting.

The present invention provides an improved container lip design offering the advantage over conventional container design that the present container can be sealed much better than conventional containers and yet have an easier opening top closure.

BRIEF DESCRIPTION OF THE DRAWINGS

FIG. 5 is an enlarged partial cross-sectional side view of the lip sealing area of the container.

FIG. 6 is an enlarged partial cross-sectional view showing a sealing cap installed; and FIG. 7 is an enlarged partial cross-sectional view of the container showing a vacuum cap installed.

DESCRIPTION OF THE PREFERRED EMBODIMENTS

Figure 1:
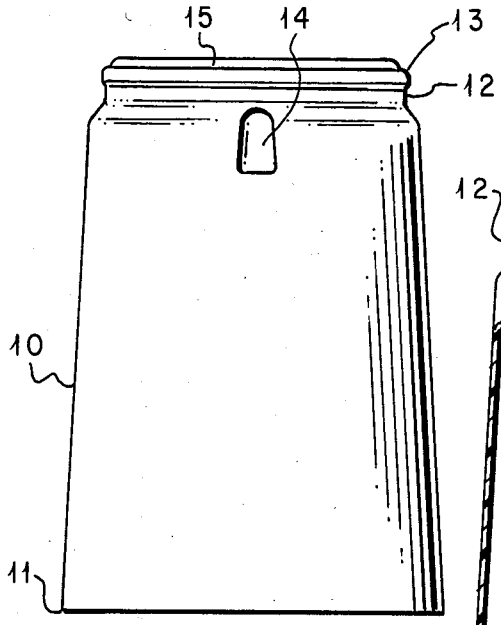
FIG. 1 is a side view of the container of this invention.

The present invention discloses an improved lip design for utilization in a container requiring a sealed flexible cover. FIG. 1 illustrates a container embodying the present invention. In FIG. 1, a generally tubular container 10 is disclosed in side elevational view. The container 10 has a slightly tapered frustoconical body portion characterized by a circular cross-section. Tapered body portion 10 terminates in a bottom skirt section 11 comprising a circular end member spinwelded into sealing engagement in body portion 10. At the upper portion of body member 10 is an inset neck portion 12 defining a seal rim 13. A plurality of indentations or nesting lugs 14 may be formed in the wall of body portion 10. Sealing rim 13 defines a relatively large generally circular opening 15 providing entry into the container 10.

Figure 2:
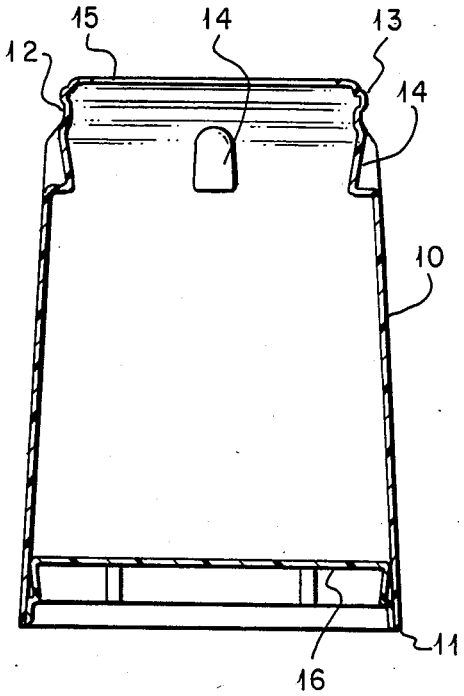
FIG. 2 is a cross-sectional side view of the container of FIG. 1.

FIG. 2 illustrates a cross-sectional side view of the container illustrated in FIG. 1. In FIG. 2, the container body 10 has fused therein a bottom closure member 16 which is spinwelded inside lower skirt portion 11. The nature of nesting lugs 14 may be seen more clearly in FIG. 2, as well as the nature of seal rim 13 and container opening area 15.

Figure 3:
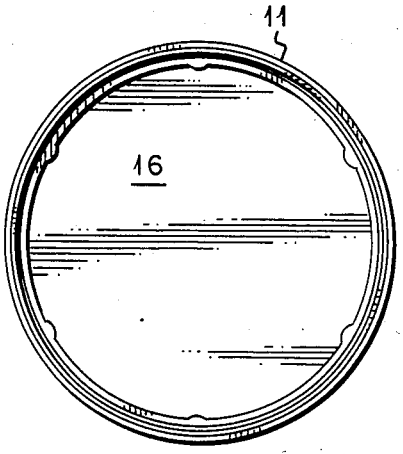
FIG. 3 is a bottom view of the container.
Figure 4:
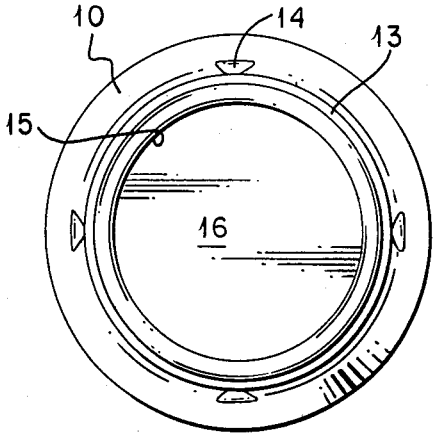
FIG. 4 is a top view of the container.

FIG. 3 illustrates a bottom view of the container 10 showing the container bottom 16 sealingly fused into skirt portion 11. FIG. 4 is a top view of the container 10 illustrating the sealing rim 13, opening 15 and nesting lugs 14 as well as a top view of bottom closure member 16.

Referring now to FIG. 5, an enlarged partial cross-sectional side view of the seal rim area 13 of container 10 is disclosed. In FIG. 5, the slightly tapered frustoconical body of container 10 terminates in a gradual radius 20 which reverses into a second radius 21 and a generally cylindrical inset shoulder area 22. A complementary set of radiuses 23 and 24 merge inset shoulder area 22 into seal rim area 13. The upper edge of seal rim 13 is defined by a more radical radius 25 into a slightly sloping, almost horizontal secondary annular flat 26. A primary annular flat 27 is offset from secondary annular flat 26 by a raised shoulder section 28. The primary annular flat 27 terminates at a relatively sharp corner 29 which joins a downwardly and inwardly sloping frustoconical section 30 to primary flat 27. The termination of container material then occurs in an inwardly projecting rim 31 at the lower edge of conical section 30. Shoulder 31 defines opening 15 in the container.

FIG. 6 is an enlarged partial cross-sectional view similar to FIG. 5 but illustrating the addition of a metal foil cap in sealing engagement over the top portion of container 10. In FIG. 6 the thin metal foil cap 40 is shown in a crimped relation around seal rim 13 with an annular space formed along secondary flat 26 which annular space preferably is filled with a sealing adhesive 41. The metal foil 40 extends entirely across opening 15 thereby fully enclosing the upper portion of container 10. A second bead of adhesive 42 may optionally be provided between sealing cap 40 and surface 30. It is believed that the entrapment of adhesive 41 in the indented area 26 provides a much more positive sealing effect than the seal cap 40 could obtain in the absence of annular indentation 26.

FIG. 7 is an enlarged partial cross-sectional view of container 10 in the upper seal rim area 13 illustrating the use of a metal foil cap 50 sealed by an adhesive 51 across opening 15. In this embodiment, the metal foil cap 50 is formed preferably of a relatively soft ductile material such as aluminum foil so that the container and the cap 50 may be utilized for "hot-filling" of flowable liquid products. In the illustration of FIG. 7, the foil cap 50 is shown with an indented area 52 following the general contours of the upper portion of container 10 in the opening area of 15. During the hotfilling operation mentioned above, hot material is placed in container 10 and foil cap 50 is sealingly attached by the means of adhesive 51 and 52 and a crimping radially inward along the bottom edge 53 of the cap. When initially placed over opening 15, cap 52 is flat across the top.

Upon cooling of the hot-filled material in container 10, a contraction of the contents and the air trapped at the top of the material will cause an inward drawing of the container components. The ductile nature of foil cap 50 allows the contraction due to temperature changes to be absorbed by the cap material rather than the container. This prevents a "paneling" of the container wall and contributes to the strength and aesthetic appeal of the filled container. Upon the inward drawing of foil cap 50 in reaction to cooling of the contents of the container, the foil cap will achieve the indented configuration shown in FIG. 7 at reference number 54. It is believed that the provision of an excess of adhesive material 51 in indentation 26 prevents slipping of the foil cap member 50 during the aforementioned contraction in area 54. It is also believed that the provision of a relatively thick bead 51 of adhesive in area 26 also prevents air bubbles and other cavities in the adhesive material from allowing the foil cap member 50 to leak. This is believed to be due to the relative excess of seal material allowed by indentation 26. In addition to the sealing ability of this "stepped" configuration, crimping of the foil member 50 at the lower end 53 below shoulder area 13 provides additional gripping of the foil cap on the container top.

Another advantage of the present invention is that it allows the container to be filled and sealed without the need for adhesive in the lower cap portion 53. Since sufficient adhesive is provided at 51 and 52 to seal the cap member to the container top, the skirt section 53 of the foil cap may be crimped only, thus allowing the end user an easy means of peeling up sufficient foil cap member area to get a good grip on the cap for continued removal of the cap from the container end. Conventional methods of sealing would provided adhesive material all the way to the bottom of cap member 50 in the area of skirt 53, thus creating a difficult to remove seal member since one would have problems lifting the lower edge 53 of the cap member.

Thus the present invention discloses an improved sealing lip design for containers and more preferably for thermoplastic containers having deformable cap members such as aluminum foil caps sealingly attached to the top openings by means such as a flowable adhesive. The improved sealing structure provides an excess of sealing material in an annular trapped area between the cap and the container rim and also allows the lower portion of the cap member to be held to the container top solely by crimping, in the absence of seal adhesive, thereby allowing ease of removal of the container lid from the container. The improved container sealing apparatus also provides for a controlled contraction of the ingredients when used in hot-fill applications.

Although a specific preferred embodiment of the present invention has been described in the detailed description above, the description is not intended to limit the invention to the particular forms or embodiments disclosed therein since they are to be recognized as illustrative rather than restrictive and it will be obvious to those skilled in the art that the invention is not so limited. For example, the closure has been described as a thermoplastic, tapered, conical shape whereas it is obvious that other shapes such as cylindrical could be utilized with the upper sealing structure disclosed in the present invention. Also, bottom closure members can be attached by means other than spinwelding. Thus, the invention is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. A container having a vertical side wall, a bottom closure, and a top rim, said top rim defining a top opening, said container further comprising:

a seal rim formed on said top rim and having a stepped upper surface with a first radially inward located sealing surface, and a second radially outward sealing surface connected to said first sealing surface;

said first and second sealing surfaces being separated by a vertical stepped portion arranged to form an annular recessed sealing area;

wherein said first sealing surface forms the uppermost rim portion of said top rim and is generally defined by concentric, generally vertical surfaces separated by a generally horizontal surface; and said second sealing surface comprises a generally horizontal sealing surface merging with the outermost vertical surface of said first sealing surface, and a vertical outwardly projecting roll rim defining a lower inset portion adapted to receive a crimped top closure thereon.

2. A sealed container having a generally vertical sidewall portion, a bottom closure, a top rim portion, and a deformable top cap sealingly enclosing said top portion; said container further comprising:

a first sealing shoulder formed around said top rim and defining the uppermost portion of said container and further defining the top opening of said container;

a second sealing shoulder on said top rim portion, located radially outward from said first sealing shoulder and downwardly displaced therefrom;

an annular recess defined by the conjunction of said first and second shoulders;

an outward projecting crimping shoulder formed on said second sealing shoulder;

flowable adhesive means in said annular recess; and a closure cap over said container opening, adhered by said adhesive means to said top rim portion, and formed of a deformable material.

3. The sealed container of claim 2 wherein said closure cap is formed of a soft metal foil and is crimped over said crimping shoulder.

4. The sealed container of claim 3 wherein said container is thereformed from a thermoplastic material and said bottom closure is friction-welded to said sidewall portion.

* * * * *